United States Patent [19]

Näslund

[11] 4,143,499

[45] Mar. 13, 1979

[54] ROOFING SHEET

[75] Inventor: Gustav Näslund, Älvsbyn, Sweden

[73] Assignee: Korsträsk Mekaniska, G Näslund, Älvsbyn, Sweden

[21] Appl. No.: 812,772

[22] Filed: Jul. 5, 1977

[30] Foreign Application Priority Data

Jul. 6, 1976 [SE] Sweden ..... 7607724

[51] Int. Cl.[2] ..... E04C 2/32

[52] U.S. Cl. ..... 52/630; 29/455 LM; 428/180; 52/450

[58] Field of Search ..... 52/630, 450, 454, 618, 52/625, 674, 334; 29/455 LM; 428/180, 182, 184

[56] References Cited

U.S. PATENT DOCUMENTS

| | | | |
|---|---|---|---|
| 1,616,968 | 2/1927 | Hall | 52/630 |
| 3,217,845 | 11/1965 | Reynolds et al. | 52/618 |

*Primary Examiner*—James L. Ridgill, Jr.

*Attorney, Agent, or Firm*—Kenyon & Kenyon, Reilly, Carr, Chapin

[57] ABSTRACT

A corrugated roofing sheet has special elevations formed in the wave crest of the sheet, the elevations being contoured to increase the sheet's rigidity while permitting the elevations to function as a ladder. The elevations provide effective rigidfying while leaving the valleys of the sheet corrugations free for drainage.

1 Claim, 4 Drawing Figures

ROOFING SHEET

This invention relates to a roofing sheet of corrugated type, more precisely to a roofing sheet with corrugation of sinus or wave shape.

Sheets of such shapes and of various materials are known and used for roofing and facing purposes. Owing to their sinus or wave shape, however, these sheets are relatively unstable and sensitive to local pressure loads directed to the wave crests and, therefore, must not be exposed to such loads. With respect to roofing sheets, the said weakness implies that roofs assembled of such sheets with corrugation of sinus or wave shape cannot directly be stepped on, in view of the risk of causing a permanent local deformation of the wave crests. Therefore, special roof ladders and the like are to be used. A further disadvantage of said weakness is, that the fastening of the sheets by nails or screws must be carried out with a certain care, because a fastening member driven in too far down without exception gives rise to a depression about the head of the fastening member, in which depression water will collect and from there through the hole formed at the driving-in operation trickle down along the fastening member.

Another essential disadvantage of corrugated roofing sheet is its appearance, which by many is deemed unattractive from an aesthetic point of view. This applies also to roofing sheets with trapezoid corrugation.

The present invention, therefore, has the object of producing a roofing sheet of the aforesaid kind, which is of such a nature that it withstands local pressure loads much better than conventional sheets and permits be stepped on to without risk of permanent deformation, and which also is aesthetically attractive.

This object is achiebed thereby that the roofing sheet according to the present invention has been given the characterizing features defined in the claims.

Figure 1:
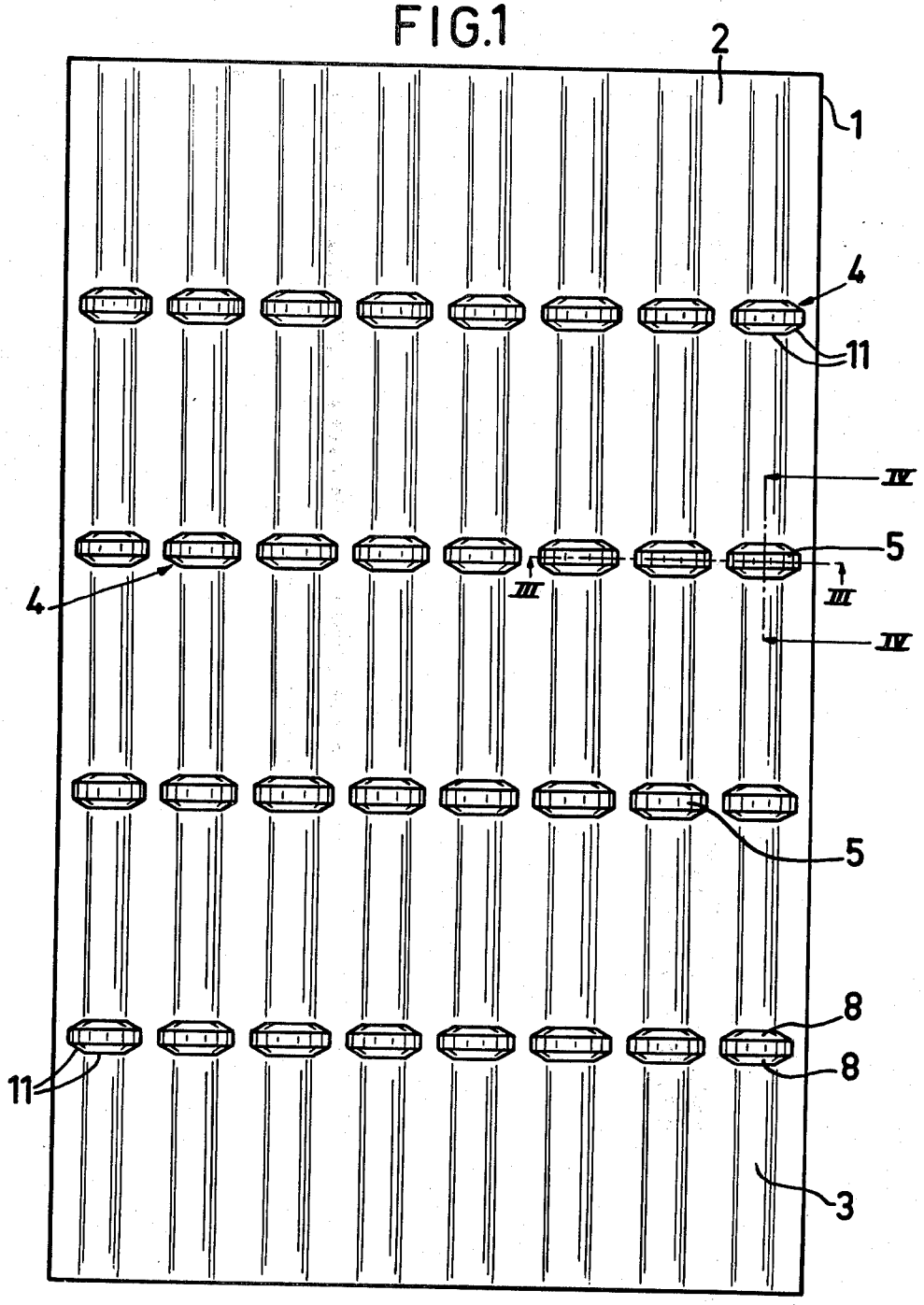
Figure 2:
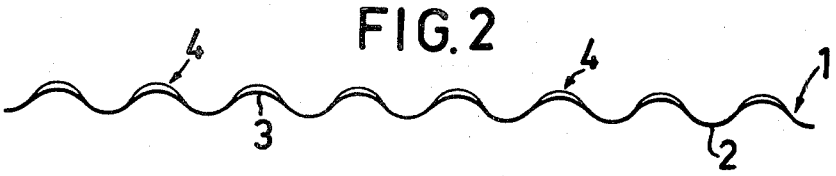
Figure 3:
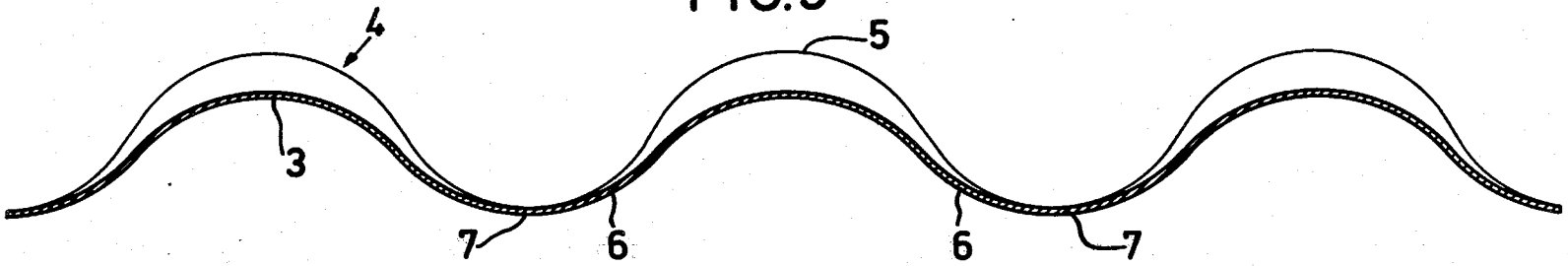
Figure 4:
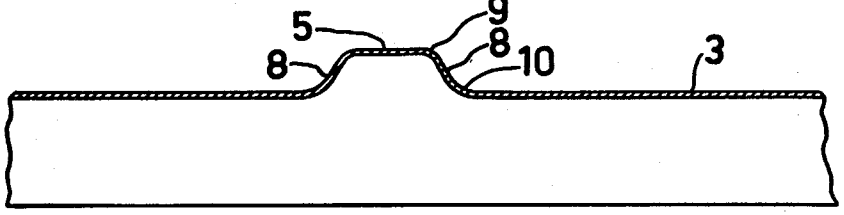

The invention is described in the following with reference to the accompanying drawings, in which FIG. 1 is a horizontal view of a sheet according to the invention, FIG. 2 is an end view of the sheet shown in FIG. 1, FIG. 3 is a section along the line III—III in FIG. 1 on an enlarged scale, and FIG. 4 is a section along the line IV—IV in FIG. 1.

The corrugated roofing sheet according to the invention shown in the Figures, which in FIG. 1 faces with its upper surface 1 toward the observer, has a sinus- or wave-shaped cross-section. The wave troughs 2 and wave crests 3 extend along the entire length of the sheet. According to the invention, the crests 3 are provided with elevations 4 brought about by impressing a tool (not shown) from the lower surface of the sheet in such a manner, that the sheet is stretched and extended without breaking. Each elevation 4 can be said to consist of an upper surface 5 with arc-shaped cross-section which smoothly and uniformly transforms into lateral portions 6 of the wave trough, spaced from the deepest point 7 therein, and of opposed lateral surfaces 8, which with a convex rounding 9 transform into the upper surface 5 of the elevation and with a concave rounding 10 transforms into the upper surface of the wave crest along the defining line 11 indicated in FIG. 1. Though not shown in FIG. 4, the upper surface 5 of each elevation may have convex arc shape instead of the plane shape shown in said Figure, and the lateral surfaces 8 may be given an inclination greater or smaller than that shown especially in FIG. 4.

By said elevations 4 in the wave crests of the sheet, the sheet stiffness is substantially increased in the area about each elevation, and by providing the sheet with such elevations 4 distributed over the entire sheet, for example in the way shown in FIG. 1 where the elevations 4 are arranged in several rows transverse across the sheet, the sheet is given such stiffness as to permit be stepped on to, whereat the elevations serve as rungs and provide a good foothold. The distance between the elevations 4 in a wave crest can be chosen to correspond to the usual c/c-distance between roof laths, at which distance such sheets normally are attached by nails or screws and which normally is 60 cm. By positioning the sheet in such a manner, that the elevations 4 are located directly above such a lath, the sheet can be fastened by driving the nails through the elevations 4, which owing to their shape ars so stable that a nail driven in too far down does not cause a depression or the like.

The distance between the elevations 4 may also be made longer or shorter than the one shown in FIG. 1, and the nails or screws for attaching the sheet may also be applied in the area adjacent each elevation, because the stiffness also of said area is increased so much that there is no risk of depression. Elevations, furthermore, must not be provided adjacent both end edges of the sheet in order to permit overlapping positioning of the sheets in a manner known per se.

Due to the elevations 4, roofs laid with roofing sheets according to the present invention have an appearance differring substantially from the expressionsless look of roofs laid with conventional roofing sheets, irrespective of whether their corrugations are sinus-shaped or trapezoid, and thereby make an aesthetically attractive impression reminding of a conventional tile roof.

The present invention is not restricted to the embodiment described above and shown in the drawings, but can be varied and modified in many different ways within the scope of the invention idea as it is defined in the claims. The elevations 4, for example, can be arranged zigzag or in another expedient way.

What I claim is:

1. A roofing sheet of the kind having sinus- or wave-shaped corrugation, having spaced elevations formed only in the wave crests of the sheet by stretching or extending the sheet from its inner surface, said elevations being arranged in several rows transverse across the sheet, each elevation comprising an upper surface with a substantially flat cross-section transforming into lateral portions of the wave troughs spaced from the deepest point in the wave troughs, and two opposed inclined side surfaces, said transforming between the side surface of each elevation and upper surface thereof and the upper surface of the wave crest being convex and concave, respectively.

* * * * *